US011246199B2

(12) United States Patent
Hou et al.

(10) Patent No.: US 11,246,199 B2
(45) Date of Patent: Feb. 8, 2022

(54) LIGHTING APPARATUS

(71) Applicant: XIAMEN ECO LIGHTING CO. LTD., Xiamen (CN)

(72) Inventors: Shouqiang Hou, Xiamen (CN); Xiaoliang Wen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/816,256

(22) Filed: Mar. 12, 2020

(65) Prior Publication Data

US 2020/0359478 A1 Nov. 12, 2020

(30) Foreign Application Priority Data

May 9, 2019 (CN) ..... 201910386359.X
May 9, 2019 (CN) ..... 201920663041.7

(51) Int. Cl.
*H05B 45/30* (2020.01)
*F21V 33/00* (2006.01)
*F21V 23/06* (2006.01)

(52) U.S. Cl.
CPC ..... *H05B 45/30* (2020.01); *F21V 23/06* (2013.01); *F21V 33/0056* (2013.01)

(58) Field of Classification Search
CPC ..... H05B 45/30; H05B 47/11; H05B 47/12; H05B 47/13; H05B 45/20; H05B 47/10; F21V 23/06; F21V 33/0056; F21V 23/003; F21V 23/004; F21V 23/005; F21V 23/006; F21V 23/007; F21V 23/008; F21V 23/009; H01Q 1/00; F21S 8/03; F21S 8/04; F21S 8/043; F21K 9/20; F21K 9/232
See application file for complete search history.

(56) References Cited

U.S. PATENT DOCUMENTS 7,264,384 B1 * 9/2007 Ryan ..... B63B 17/02 362/477
9,892,696 B2 * 2/2018 Yang ..... G09G 3/2003
10,321,547 B1 * 6/2019 Recker ..... H05B 47/11
2005/0141997 A1 * 6/2005 Rast ..... F04D 27/008 416/229 R
2009/0290343 A1 * 11/2009 Brown ..... F21V 17/12 362/235
2011/0242828 A1 * 10/2011 Blincoe ..... F21V 23/008 362/373
2012/0014102 A1 * 1/2012 Caroom, Jr. ..... H01R 25/14 362/249.02
2012/0043889 A1 * 2/2012 Recker ..... H05B 45/37 315/86

(Continued)

*Primary Examiner* — Abdullah A Riyami
*Assistant Examiner* — Syed M Kaiser
(74) *Attorney, Agent, or Firm* — Chun-Ming Shih; Lanway IPR Services

(57) ABSTRACT

A lighting apparatus includes a light source, a driver module and a surface rim. The light source includes multiple LED modules and a power electrode. The driver module includes a driver box and a first driver circuit. The first driver circuit is stored in the driver box. The first driver circuit is electrically connected to the power electrode of the light source for providing a driving current to the LED modules. The surface rim has a central portion and a peripheral portion. The light source is disposed to the central portion. The driver box is concealed at least partially by the peripheral portion.

20 Claims, 8 Drawing Sheets

(56) References Cited

U.S. PATENT DOCUMENTS

| | | | | |
|---|---|---|---|---|
| 2012/0188780 | A1* | 7/2012 | Wilk | F21S 8/08 362/509 |
| 2013/0201697 | A1* | 8/2013 | Osada | F21K 9/20 362/373 |
| 2013/0258689 | A1* | 10/2013 | Takahira | F21S 41/176 362/465 |
| 2014/0232289 | A1* | 8/2014 | Brandes | H05B 45/48 315/250 |
| 2014/0267461 | A1* | 9/2014 | Sarmadi | H05B 45/37 345/690 |
| 2014/0300274 | A1* | 10/2014 | Acatrinei | F21K 9/232 315/85 |
| 2015/0043224 | A1* | 2/2015 | Chen | F21S 8/02 362/365 |
| 2015/0165114 | A1* | 6/2015 | Grant | A61M 5/14224 604/151 |
| 2015/0351195 | A1* | 12/2015 | Sargent | F21V 15/01 315/158 |
| 2016/0018093 | A1* | 1/2016 | Van Winkle | F21K 9/238 362/311.02 |
| 2016/0281939 | A1* | 9/2016 | Luk | F21V 21/047 |
| 2016/0320007 | A1* | 11/2016 | Araki | F21V 19/004 |
| 2016/0366746 | A1* | 12/2016 | van de Ven | H05B 45/20 |
| 2017/0223807 | A1* | 8/2017 | Recker | H05B 47/19 |
| 2017/0227207 | A1* | 8/2017 | Bendtsen | F21V 23/0464 |
| 2017/0374724 | A1* | 12/2017 | Liszt | H05B 47/19 |
| 2018/0010782 | A1* | 1/2018 | Galvez, Sr. | F21K 9/68 |
| 2018/0206305 | A1* | 7/2018 | Van Winkle | F21V 19/002 |
| 2018/0320882 | A1* | 11/2018 | Jenson | F21V 29/83 |
| 2019/0058003 | A1* | 2/2019 | Blakely | H01L 25/0753 |
| 2019/0342975 | A1* | 11/2019 | Diana | H05B 47/11 |
| 2020/0191344 | A1* | 6/2020 | Van Winkle | F21S 8/026 |
| 2020/0391658 | A1* | 12/2020 | Diana | H05K 1/189 |

* cited by examiner

LIGHTING APPARATUS

FIELD

The present invention is related to a lighting apparatus and more particularly related to a lighting apparatus with added functions.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In some embodiments, a lighting apparatus includes a light source, a driver module and a surface rim.

The light source includes a plurality of LED modules and a power electrode. The driver module includes a driver box and a first driver circuit. The first driver circuit is stored in the driver box.

The first driver circuit is electrically connected to the power electrode of the light source for providing a driving current to the LED modules.

The surface rim has a central portion and a peripheral portion. The light source is disposed to the central portion and emits a light to a central opening of the central portion.

The driver box is concealed at least partially by the peripheral portion. The peripheral portion has a surrounding side wall. The surrounding side wall has a container hole. The driver box has a lateral wall fitting the container hole. The surrounding side wall and the lateral wall together surround the central portion and the light source.

In some embodiments, the lighting apparatus also includes a back plate. The driver box is disposed on a driver base for connecting to an external power source.

In some embodiments, the peripheral portion has a container space. The driver box is kept in a portion of the container space.

In some embodiments, the driver box has a sector shape.

In some embodiments, the lateral wall of the driver box aligns with the surrounding wall of the peripheral portion of the surface rim so that the lateral wall appears as a part of the surrounding wall.

In some embodiments, there are multiple types of the first driver circuit placed in the same shape of the driver box to be replaced to correspond to different types of the light source.

In some embodiments, the electrode is plugging to a connector for receiving the driving current from the first driver circuit.

In some embodiments, an augmented device is placed outside the lateral wall of the driver box, exposed toward the central opening.

In some embodiments, the augmented device is an antenna used by the first driver circuit.

In some embodiments, the augmented device is a sensor for collecting an environment status.

In some embodiments, the peripheral portion of the surface rim provides a second container for storing an extended box.

In some embodiments, the extended box contains a second driver circuit working together with the first driver circuit.

In some embodiments, the extended box contains a function module for adding a function of the lighting apparatus.

In some embodiments, the extended box contains a wireless hub circuit providing a wireless hotspot service.

In some embodiments, the extended box contains a speaker for playing audio information.

In some embodiments, the extended box is detachable from the peripheral portion of the surface rim.

In some embodiments, the extended box provides an extended light source emitting light in addition to the light source.

In some embodiments, the driver box is inserted into a container via the central opening and the container hole.

In some embodiments, the driver box has a plugging structure to fix to the peripheral portion of the surface rim by plugging.

In some embodiments, when the driver box is plugged into the container, the first circuit is electrically connected to an external power source and the light source when the driver box is plugged to the plugging structure.

DETAILED DESCRIPTION

Figure 10:
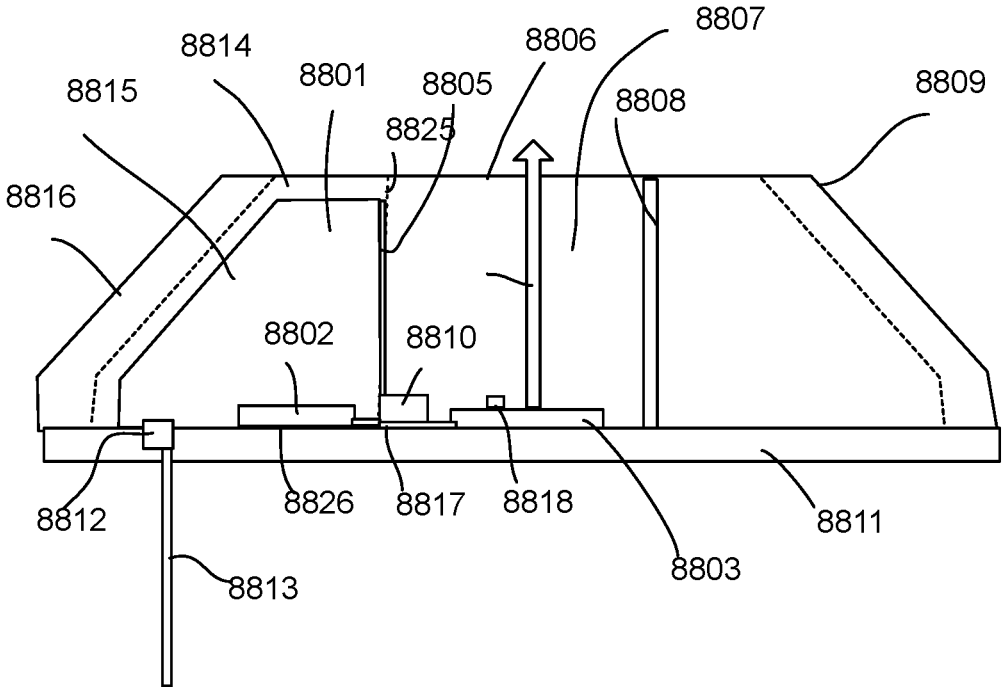
FIG. 10 shows a diagram of a general embodiment.
Figure 11:
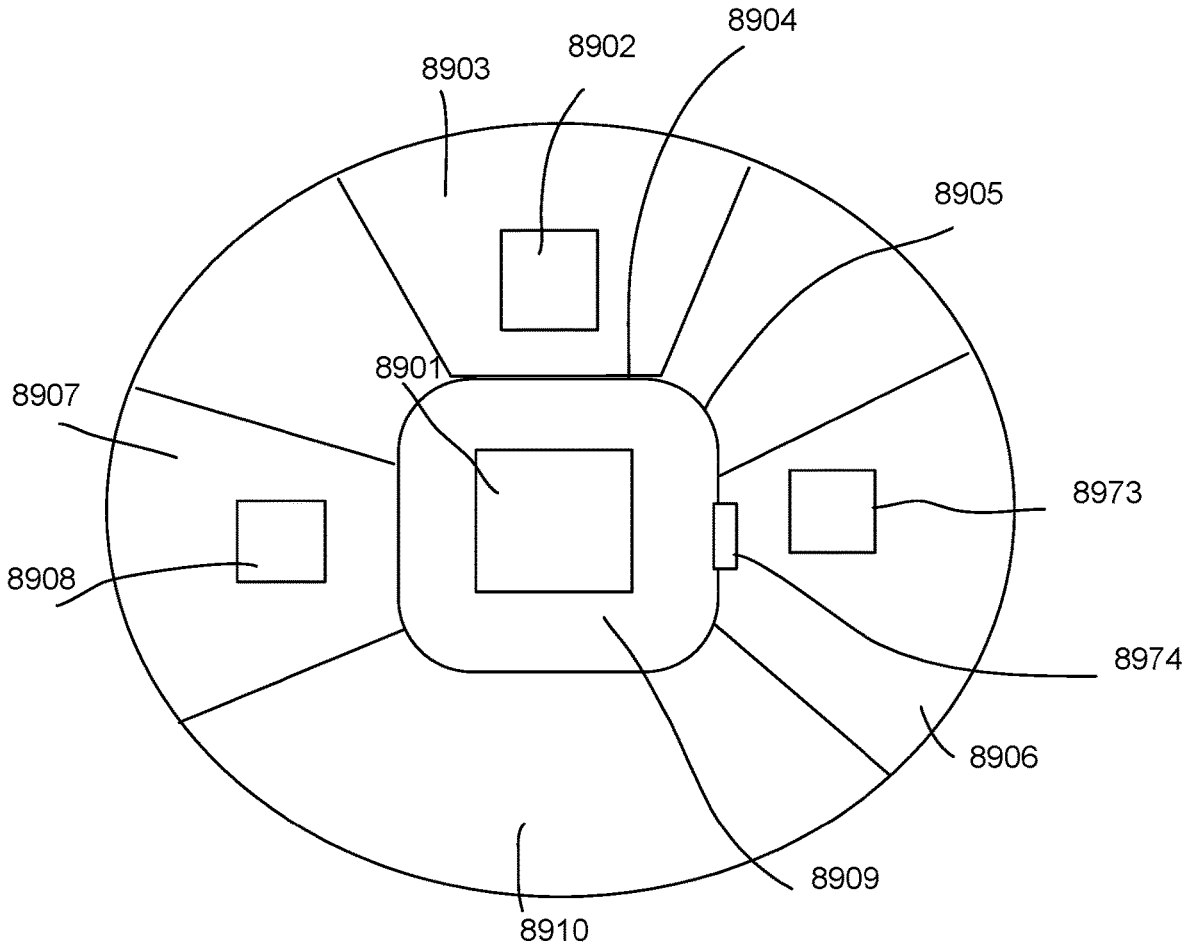
FIG. 11 shows another view of an example.

Please refer to FIG. 10 and FIG. 11, in some embodiments, a lighting apparatus includes a light source 8803, a driver module 8815 and a surface rim 8816.

The light source 8803 includes a plurality of LED modules 8818 and a power electrode 8817. The driver module 8815 includes a driver box 8801 and a first driver circuit 8802. The first driver circuit 8802 is stored in the driver box 8801.

The driver box 8801 may have various shapes. In some embodiments, the driver box is designed to fit in an inner wall of the peripheral portion so as to enhance heat dissipation and also to enhance rigidity of the overall structure.

The first driver circuit 8802 is electrically connected to the power electrode 8817 of the light source 8803 for providing a driving current to the LED modules 8818. For example, the first driver circuit 8802 may include a rectifier, a filter and other components for converting an indoor power like 110V alternating current to a direct current power source.

The surface rim 8816 has a central portion 8807 and a peripheral portion 8809. The light source 8803 is disposed to the central portion 8807 and emits a light to a central opening 8806 of the central portion 8807.

The driver box 8801 is concealed at least partially by the peripheral portion 8809. In other words, the driver is not exposed directly in the central portion of the surface rim and also decreases interference to light emitting of the light source, e.g. to render an undesired shadow.

The peripheral portion 8809 has a surrounding side wall 8808. The surrounding side wall 8808 has a container hole 8825. The container hole provides an empty space to be filled by the driver box 8801.

The driver box 8801 has a lateral wall 8805 fitting the container hole 8825, e.g. to close the surrounding of the surrounding side wall 8808 by not leaving the container hole 8825 empty. The surrounding side wall 8808 and the lateral wall 8805 together surround the central portion 8807 and the light source 8818.

In some embodiments, the lighting apparatus also includes a back plate 8811. The driver box 8801 is disposed on a driver base 8826 for connecting to an external power source 8813.

For example, the back plate is made of metal material. The driver box is mounted on an installation platform, i.e. the driver base 8826. Wiring is added and then the surface rim is placed to attach the back cover to conceal and to hold the driver box between the surface rim and the back plate 8811.

In some embodiments, the peripheral portion 8809 has a container space 8814. The driver box 8801 is kept in a portion of the container space 8814.

A driver box 8903 has a lateral wall 8904. The lighting apparatus has a surface that has a peripheral portion 8910 and a central portion 8909. A light source 8901 is placed in the central portion 8909. There is a surrounding wall 8905 in the peripheral portion. The surrounding wall 8905 together with the lateral wall 8904 surround the light source 8901 and the central portion 8909. In this example, the driver box 8903 has a sector shape.

In some embodiments, the lateral wall of the driver box aligns with the surrounding wall of the peripheral portion of the surface rim so that the lateral wall appears as a part of the surrounding wall.

In some embodiments, there are multiple types of the first driver circuit placed in the same shape of the driver box to be replaced to correspond to different types of the light source. In other words, to fit different standards or requirements, different components of driver components may be placed in the same type and same size of the driver box. Such design provides strong flexibility and thus reduces overall manufacturing and stocking cost.

In some embodiments, the electrode is plugging to a connector for receiving the driving current from the first driver circuit. For example, a socket and related plug may be used instead of using welding to achieve electricity connection.

Please refer to FIG. 10, an augmented device 8810 is placed outside the lateral wall 8805 of the driver box 8801, exposed toward the central opening 8806.

In some embodiments, the augmented device 8810 is an antenna used by the first driver circuit 8802. Because the antenna is not covered or concealed by the driver box or the peripheral portion, signal quality may be improved. Such antenna may be used for IoT (Internet of Things) communication to make the lighting apparatus as an intelligent device.

In some embodiments, the augmented device 8810 is a sensor for collecting an environment status. For example, the sensor detects environment luminance level and the driver controls the light source based on the detected result.

Please refer to FIG. 11. In FIG. 11, the peripheral portion of the surface rim provides a second container for storing an extended box 8906.

In some embodiments, the extended box 8906 contains a second driver circuit 8973 working together with the first driver circuit. With such design, heat is not accumulated only in one position. In addition, the weight of the lighting apparatus is also balanced by such design.

In some embodiments, the extended box contains a function module for adding a function of the lighting apparatus. There are various electronic devices suitable to be installed to the lighting apparatus. Some may be directly related to lighting function, but some may be related to other independent functions, just getting power supply from the same driver.

In some embodiments, the extended box contains a wireless hub circuit providing a wireless hotspot service. For example, it is very convenient for users to place a Wi-Fi hub directly in such device, because power supply issue is solved immediately. In addition, such extended box may be detached and replaced with another extended box for getting another function.

In some embodiments, the extended box contains a speaker for playing audio information.

In some embodiments, the extended box is detachable from the peripheral portion of the surface rim.

In some embodiments, the extended box provides an extended light source 8974 emitting light in addition to the light source 8901.

In some embodiments, the driver box is inserted into a container via the central opening and the container hole.

Figure 1:
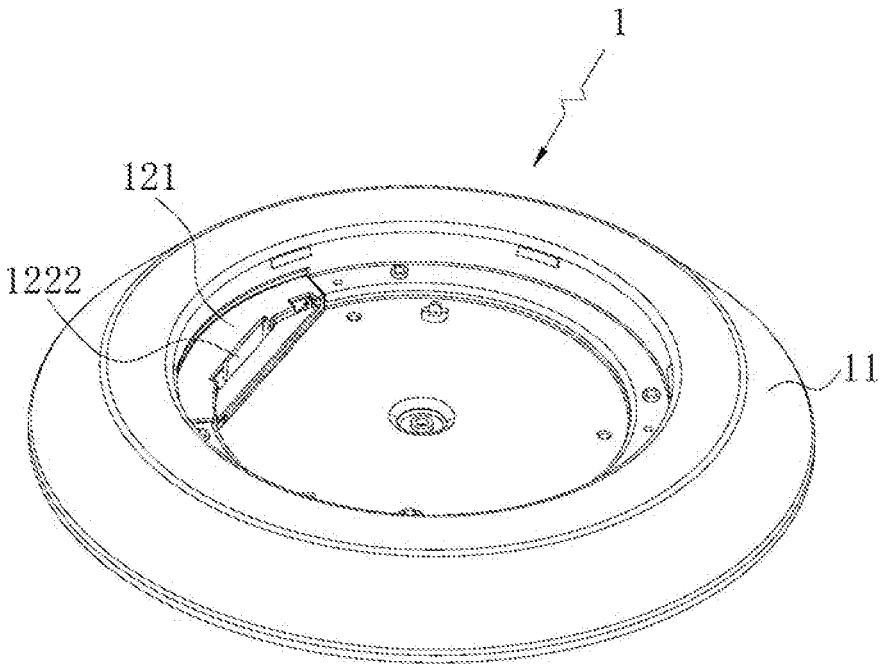
FIG. 1 illustrates an embodiment of a lighting apparatus.

In FIG. 1, the driver box has a plugging structure 8812 to fix to the peripheral portion of the surface rim by plugging.

In some embodiments, when the driver box is plugged into the container, the first circuit is electrically connected to an external power source and the light source when the driver box is plugged to the plugging structure. For example, some elastic structures are used to ensure electricity contact is well done while the driver box is plugged to the right place.

Please refer to FIG. 1 to FIG. 4, in an embodiment, a driver installation structure 1 includes a surface rim 11, a back cover 13, and a driver module 12. A light source module 2 is in the surface rim 11, and the back cover 13 is connected to the surface rim 11. The back cover 13 and the surface rim 11 may be connected to the surface rim through a rivet. The light source module 2 and the driver module 12 respectively placed on the opposite side of the surface rim 11. The driver module 12 is fixed to the back cover 13 facing to the side of the surface rim 11, and the driver module 12 is fixed near an edge of the back cover 13, which saves an internal space of an UFO lighting apparatus and releases part of the middle space of the UFO lighting apparatus for the design of an installation plate unlimited. In addition, top of an opened space of the surface rim 11 may have a container hole 110. The driver module 12 passes through the container hole 110 into the inner side of the surface rim 11 which makes it more convenient for the driver module 12 and the light source module 2 to pass through the wire and the connector to connect the electricity.

In an embodiment, the driver installation structure 1 comparing to the technology we have, the driver installation structure 1 has the driver module 12 fixed to the back cover 13 facing the side of the surface rim 11. Furthermore, the driver module 12 fixed near the edge of the back cover 13 is fixed departed from the middle of the back cover 13 for saving part of the middle space of the UFO lighting apparatus, in order to make the design of the installation plate not to be limited of the driver module 12. Besides, a driver box 121 passes through the container hole 110 of the surface rim 11 and then dives into the inner side of the surface rim 11 for the convenience of the light source module 2 and the driver module 12 to connect to each other. The driver module 12 includes a driver box 121 and a driver plate 122. The driver box 121 is fixed to the external corner of the driver plate 122 and the driver box 121 is a protection to the driver plate 122. The driver box 121 and the back cover 13 is connected to each other and the driver box 121 passes through the container hole 110 and reaches into the inner side of the surface rim 11.

Figure 2:
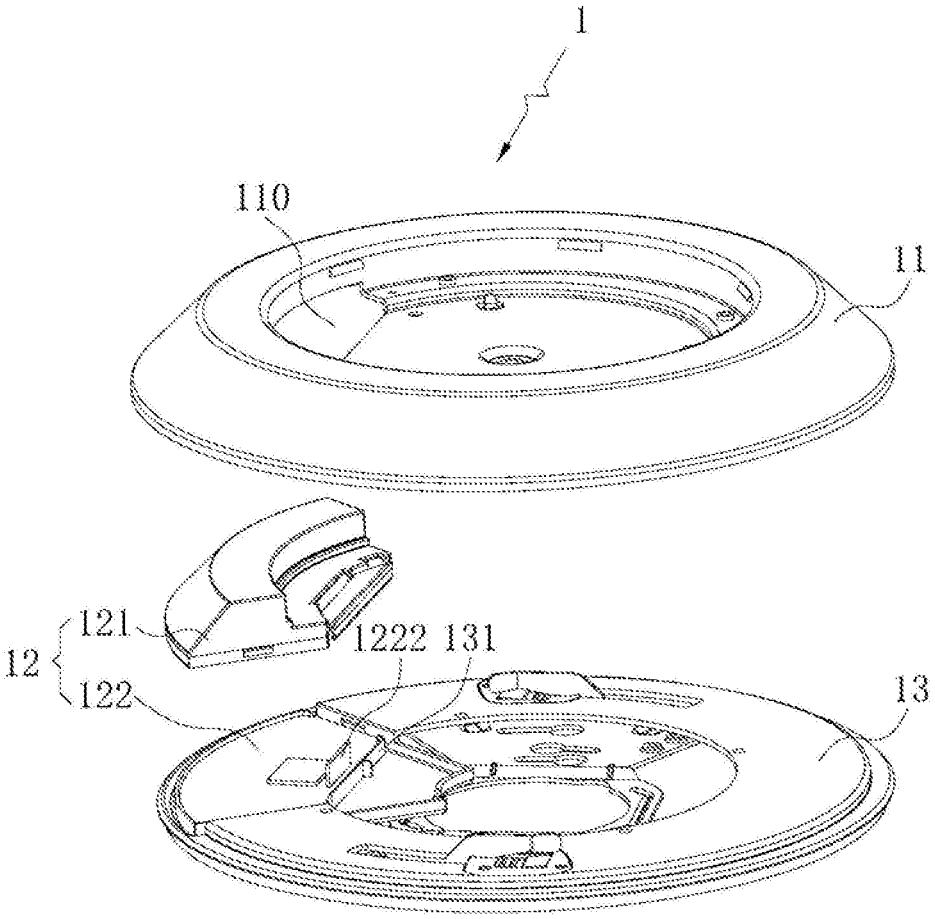
FIG. 2 is an exploded diagram of a lighting apparatus.
Figure 3:
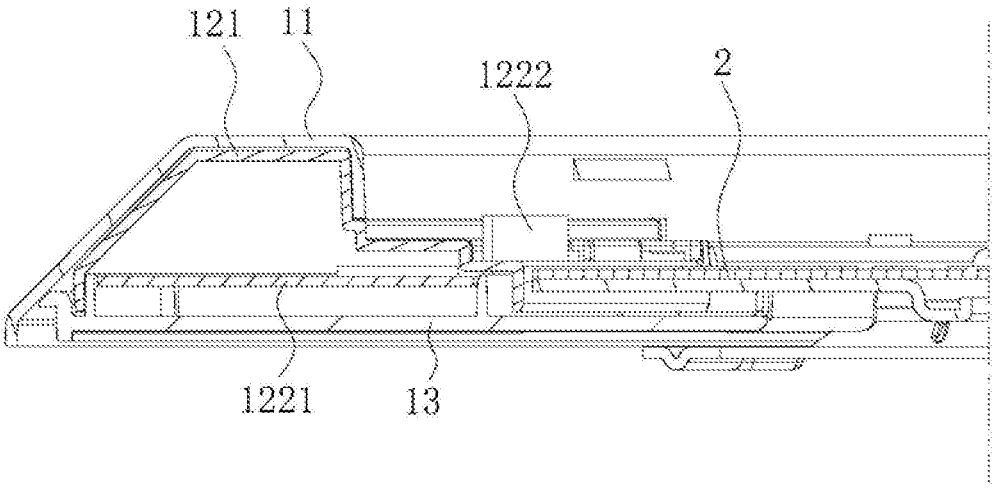
FIG. 3 is a cross sectional view.
Figure 4:
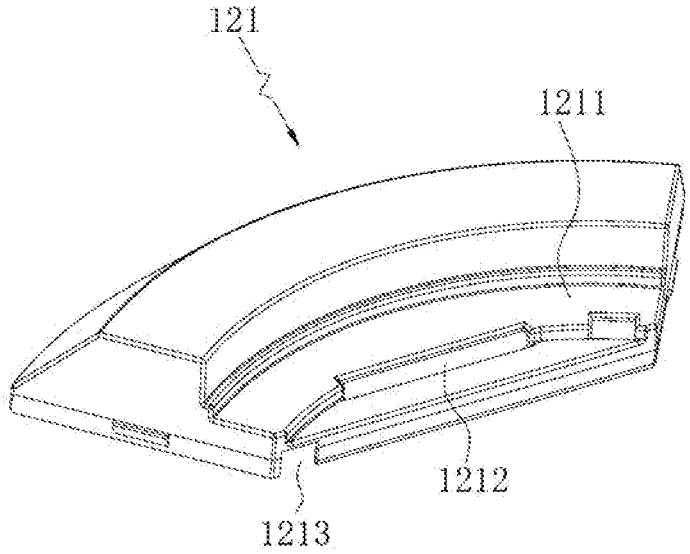
FIG. 4 is a driver box example.

Please refer to FIG. 2 to FIG. 4, in one of some embodiments, the driver box 121 has an avoidance hole 1212. The driver plate 122 includes a plate body 1221 on the back cover 13 and a communication module 1222 passed through the avoidance hole 1212. The plate body 1221 and the communication module 1222 is connected to each other, and the plate body 1221 is fixed to the back cover 13 facing a side of the surface rim 11. The plate body 1221 may be connected to the communication module 1222 vertically, and the surface of the communication module is fixed to a central axis of the back cover 13 in parallel. The communication module 1222 goes through the driver box 121 through the avoidance hole 1212, and the communication module 1222 may be covered by the driver box 121 for avoiding the decreasing of the signal and increasing the efficiency of the communication. Furthermore, to avoid the driver box 121 being too big to interfere a light passing cover 3 of the UFO lighting apparatus. The light source module 2 includes at least two kinds of color temperatures of the light source. The communication module 1222 may be Bluetooth or WIFI controlling module which through an external remote device to the communication module 1222 may control the color temperature of the light source, the power regulation and the luminous intensity.

Please refer to FIG. 2 and FIG. 4, in an embodiment, the driver box has a container side wall 1211 paralleled to the plate body 1221. The avoidance hole 1212 is on the container side wall 1211, and the surface rim 11 opened on the top without a container hole 110 for the container side wall 1211 to pass through. The communication module 1222 vertically passes through the avoidance hole 1212 of the container side wall 1211, and the whole body of the container side wall 1211 is fixed passing through the container hole 110. The communication module 1222 passes through the container side wall 1211 and the surface rim 11 the lateral side of the light source module 2, thus the light source module 2 may directly connected to the plate body 1221 through the wire or the terminal Please refer to FIG. 4 to FIG. 6, in an embodiment, the back cover 13 has the driver plate 122 for positioning and at least two stop blocks 131. The stop blocks 131 are fixed vertically to the plate body 1221, so the driver plate 122 is being limited in an area surrounded by the stop blocks 131. A bottom surface of the plate body 1221 is fixed to the back cover 13, and the plate body 1221 has four lateral side, correspondingly, the stop blocks 131 have an amount of four. Among the four stop blocks 131, two of the stop blocks 131 is respectively fixed near an edge of the back cover 13, facing to the light source module 2. Another two stop blocks is fixed to the two left lateral side of the plate body 1221. The stop blocks 131 facing the light source module 2 is a planar plate. Correspondingly, a lateral side of the plate body 1221 facing the light source module 2 is planar, and the lateral side near the external edge of the back cover 13 may be a curve surface, which makes the plate body 1221 a sector shape. This may make a best use of the space of the back cover 13 and increases the installed area of the plate body 1221. At least two of the stop blocks 131 may have a buckle, correspondingly, he external wall of the driver box 121 may also not have a buckle, so the buckle connection of the driver box 121 is on the stop block 131. In an embodiment, at least two of the stop blocks 131 may have the buckle, and the external wall of the driver box 121 may have a buckle groove correspondingly.

Figure 5:
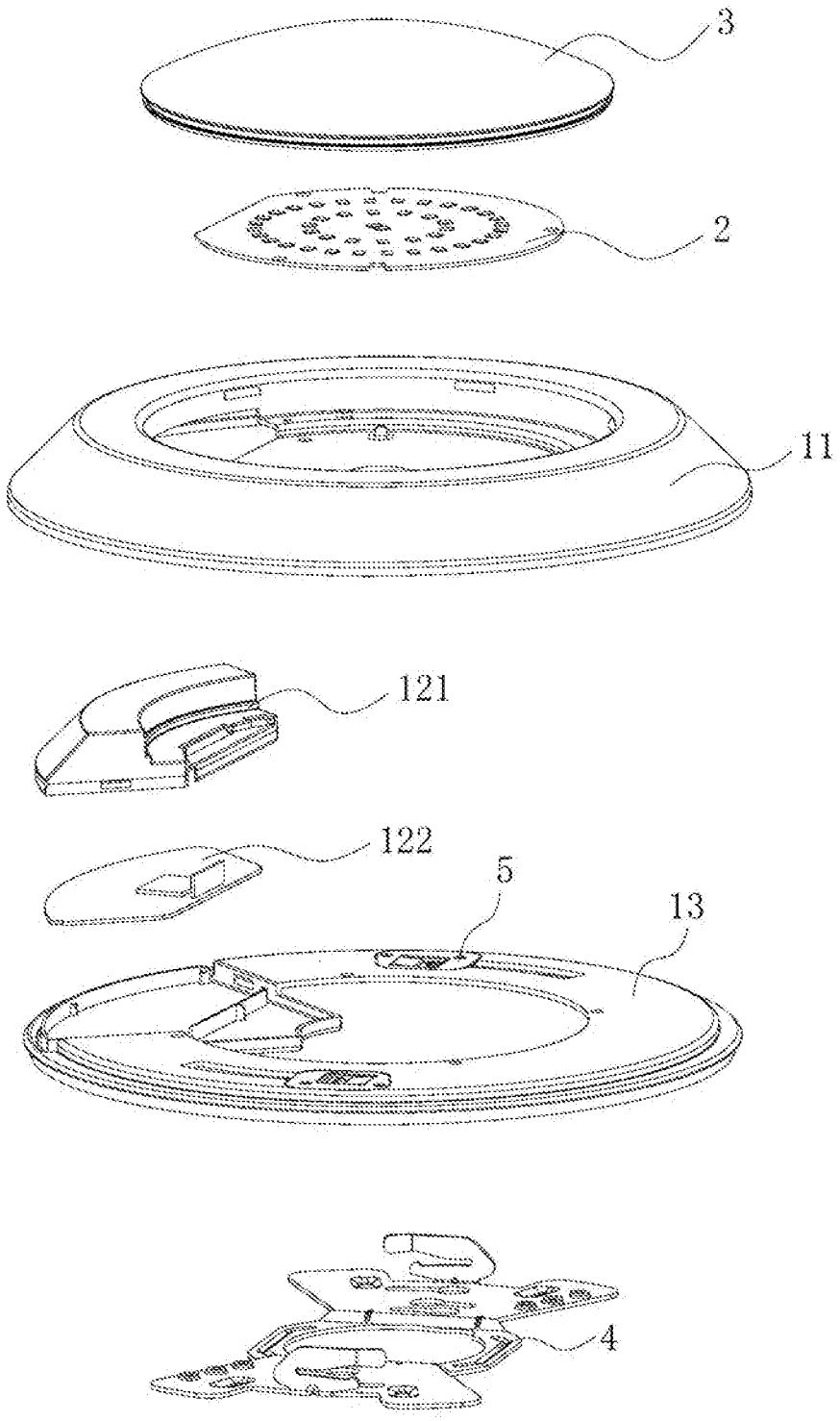
FIG. 5 is an exploded diagram of an embodiment.
Figure 6:
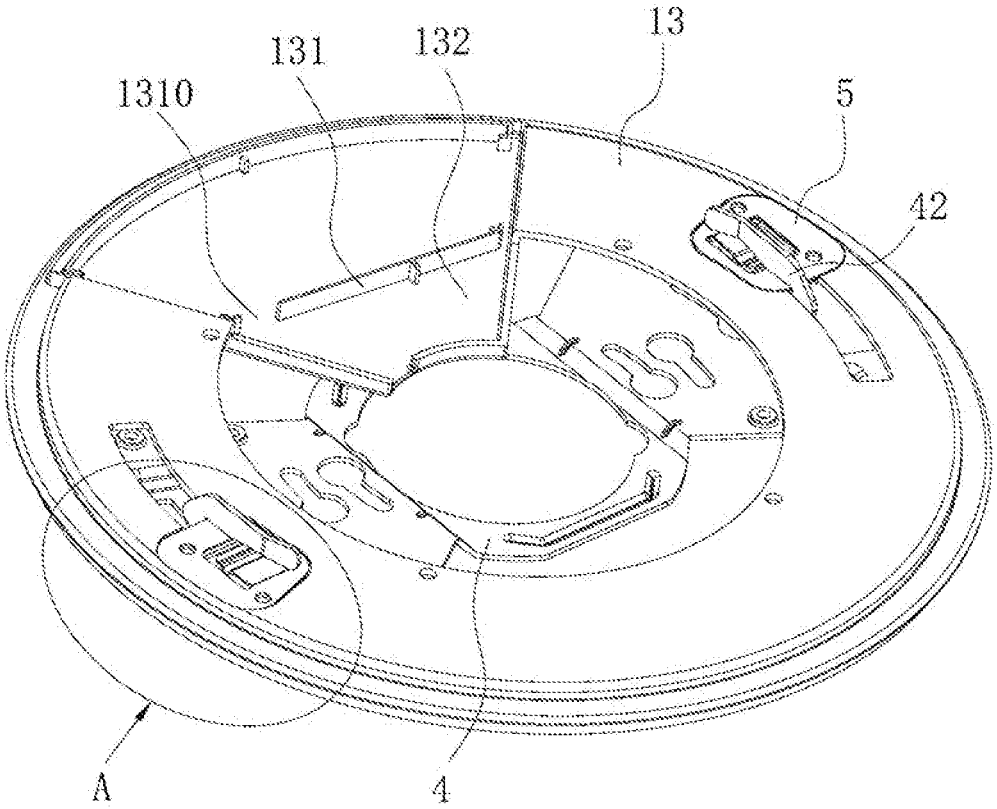
FIG. 6 shows a back plate.

Please refer to FIG. 4 to FIG. 6, in an embodiment, the stop block 131 facing the light source module 2 opened on the top may have a first line passing hole 1310 for a wire to pass through, and the driver box 121 may have a second line passing hole 1213 correspondingly to the first line passing hole 1310. The first line passing hole 1310 and the second line passing hole 1213 is fixed for the wire to pass through the stop block 131 in sequence and connects to the driver box 121 and the light source module 2, thus, the driver module 12 may be more convenient to be connected to the light source module 2.

Please refer to FIG. 6. In an embodiment, the back cover 13 may be a ring shape, and the back cover 13 has an extending sector shape board 132 extending to a center of a circle. The stop block 131 is connect to the sector shape board 132 vertically, and the driver plate 122 is placed in the area circled by the sector shape board 132 and the stop block 131, so the stop block 131 may have a positioning function to the driver plate 122. The sector shape board 132 may provide enough installing surface for the driver plate 122 to avoid the inner ring hole of the back cover 13 too big to install the driver plate 122.

Please refer to FIG. 5 to FIG. 9. In an embodiment, it also provides an UFO lighting apparatus. In an embodiment, the UFO lighting apparatus includes the driver installation structure 1 in any one of embodiments, and it also includes the light source module 2, the lighting passing cover 3 and the installation plate 4. The light source module 2 is fixed inside the surface rim 11, avoiding the driver module 12 and the lighting passing cover 3 to be installed on the light source module 2, to protect the light source module 2 and to even the light emitted from the light source module 2. The installation plate 4 is fixed on the back cover 13, so that the UFO lighting apparatus may be fixed in places, such as ceilings or walls etc., by the installation plate 4. Optionally, the light source module 2 is fixed on the surface rim 11 by fasteners, such as a rivet.

Figure 7:
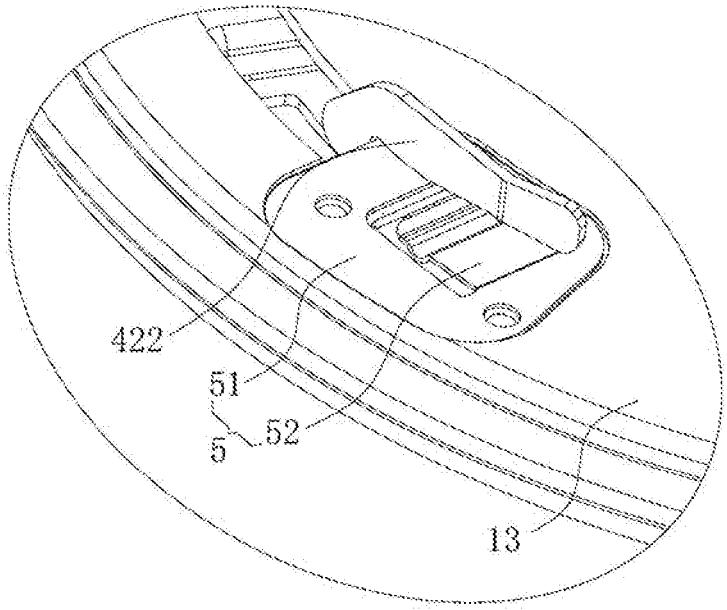
FIG. 7 shows an enlarged view of a portion in FIG. 6.
Figure 8:
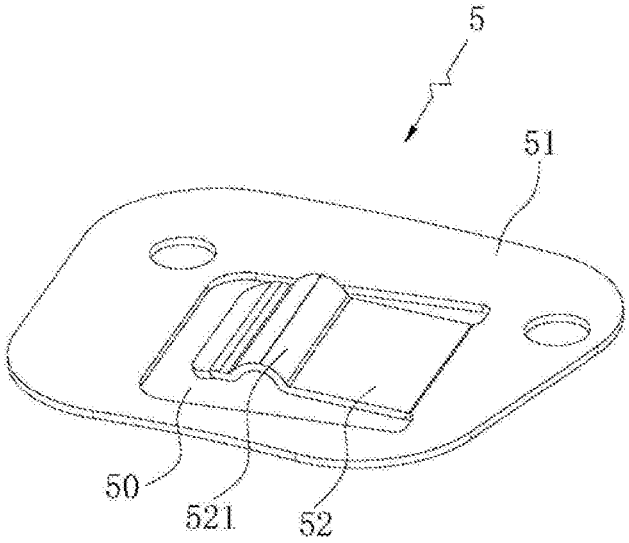
FIG. 8 is a component example.
Figure 9:
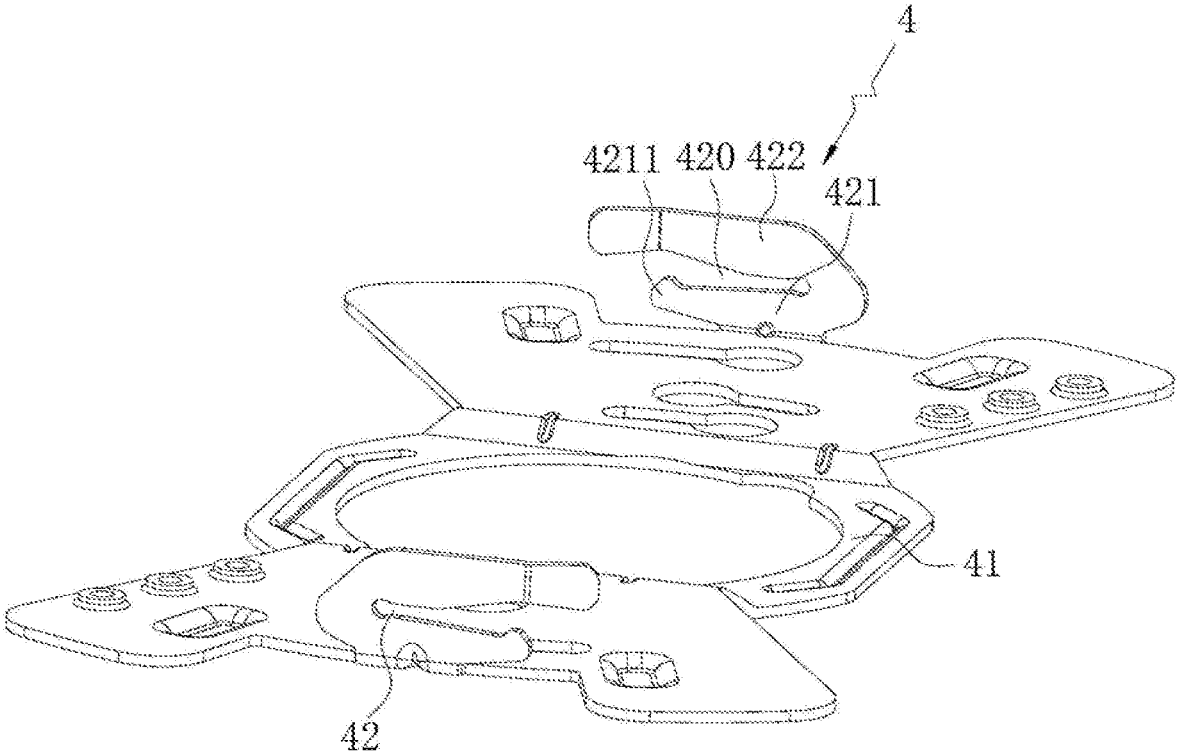
FIG. 9 is an example of a back plate.

Please refer to FIG. 7 to FIG. 9. In an embodiment, the shrapnel 5, which is used to prevent the installation plate 4 from flaking, is fixed on the back cover 13. The installation plate 4 has a buckle connection to the shrapnel 5 and the back cover 13. When the installation plate is installed on the back cover 13, the installation plate 4 revolves on the opposite of the shrapnel 5, to make the back cover 13 and the shrapnel 5 has a buckle connection in the installation plate 4 one by one. To implement the fixation of the installation plate 4 and back cover 13. The turning central axis of the installation plate 4 is considered to be the central axis of the back cover 13. More specifically, the installation plate 4 includes the central plate 41 and at least two buckle structure 42, which is connected with the central plate 41. The buckle structure 42 is useful for having a buckle connection with the shrapnel 5 and the back cover 13. The buckle structure has the same quantity as the shrapnel 5, they have a buckle connection in order. Each of the buckle structure 42 is installed along the radial direction of the central plate 41.

In some embodiments, a buckle structure 42 includes a first buckle connection buckle part 421 and a second buckle connection buckle part 422 bent connecting with the first buckle connection buckle part 421. A buckle groove 420 for a use of the buckle connection buckle elastic clip 5 is between the first buckle connection buckle part 421 and the second buckle connection buckle part 422. A facing inner wall of the first buckle connection buckle part 421 and the second buckle connection buckle part 422 connected to be the buckle groove 420. When the back cover 13 opposite to the installation plate 4 rotates, the back cover 13 and the buckle elastic clip goes into the buckle groove 420 one by one until the back cover 13 and a connecting part of the first buckle connection buckle part 421 and the second buckle connection buckle part 422 connected together. This installation is more convenient, it may not be movable, and steadier, and the back cover 13 may not fall apart from the installation plate even when vibration.

Please refer to FIG. 8 and FIG. 9, the buckle elastic clip 5 has a protrusion part 521 facing the first buckle connection buckle part 421. The first buckle connection buckle part 421 has a buckle hook 4211 to prevent the protrusion part 521 fall apart from the buckle groove 420. An inner part of the buckle hook 4211 facing the buckle groove 420 has a protrusion portion, to lessen the width of the buckle groove 420 so that the protrusion part 521 of the buckle elastic clip 5 being limited in the buckle groove 420 for preventing the back cover 13 fell apart when vibration. In an embodiment, the buckle elastic clip 5 has the protrusion part facing the second buckle connection buckle part 422, and the buckle hook 4211 is fixed in the second buckle connection buckle part 422.

Please refer FIG. 8, the buckle elastic clip 5 has a U-shaped groove 50 for the buckle elastic clip 5 being made by a fixing part 51 and an arm part 52. The fixing part 51 is fixed to the back cover 13, and the arm part 52 buckle connecting to the buckle groove 420. The back cover 13 has an elastic clip hole for hanging the arm part 52. When the arm part 52 is being squeezed, the arm part 52 actives corresponding to the fixing part 51.

Among them, the protrusion part 521 is on the arm part 52. When the buckle elastic clip 5 buckle connecting to a buckle structure 42, an inner side of the buckle groove 420 squeezes the protrusion part 521 of the arm part 52 which make the arm part 52 actives corresponding to the fixing part 51 into the buckle groove 420. The fixing part 51 may pass the rivet and the fasteners on the back cover 13 to make sure the arm part 52 hanging, and the back cover 13 has an elastic clip hole right facing the arm part 52.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source comprising a plurality of LED modules and a power electrode;

a driver module comprising a driver box and a first driver circuit, the first driver circuit being stored in the driver box, the first driver circuit being electrically connected to the power electrode of the light source for providing a driving current to the LED modules;

a back plate; and a surface rim having a central portion and a peripheral portion, the light source being disposed to the central portion and emitting a light to a central opening of the central portion, the driver box being concealed at least partially by the peripheral portion, the back plate being connected to the surface rim, the driver box being placed between the peripheral portion and the back plate, the peripheral portion having a surrounding side wall, the surrounding side wall having a container hole, the driver box having a lateral wall fitting the container hole, the surrounding side wall and the lateral wall together surrounding the central portion and the light source.

2. The lighting apparatus of claim 1, wherein the driver box is disposed on a driver base for connecting to an external power source.

3. The lighting apparatus of claim 2, wherein the peripheral portion has a container space, the driver box is kept in a portion of the container space.

4. The lighting apparatus of claim 3, wherein the driver box has a sector shape.

5. The lighting apparatus of claim 3, wherein the lateral wall of the driver box aligns with the surrounding wall of the peripheral portion of the surface rim so that the lateral wall appears as a part of the surrounding wall.

6. The lighting apparatus of claim 1, wherein there are multiple types of the first driver circuit placed in the same shape of the driver box to be replaced to correspond to different types of the light source.

7. The lighting apparatus of claim 1, wherein the electrode is plugging to a connector for receiving the driving current from the first driver circuit.

8. The lighting apparatus of claim 1, wherein an augmented device is placed outside the lateral wall of the driver box, exposed toward the central opening.

9. The lighting apparatus of claim 8, wherein the augmented device is an antenna used by the first driver circuit.

10. The lighting apparatus of claim 8, wherein the augmented device is a sensor for collecting an environment status.

11. The lighting apparatus of claim 1, wherein the peripheral portion of the surface rim provides a second container for storing an extended box.

12. The lighting apparatus of claim 11, wherein the extended box contains a second driver circuit working together with the first driver circuit.

13. The lighting apparatus of claim 11, wherein the extended box contains a function module for adding a function of the lighting apparatus.

14. The lighting apparatus of claim 13, wherein the extended box contains a wireless hub circuit providing a wireless hotspot service.

15. The lighting apparatus of claim 13, wherein the extended box contains a speaker for playing audio information.

16. The lighting apparatus of claim 11, wherein the extended box is detachable from the peripheral portion of the surface rim.

17. The lighting apparatus of claim 11, wherein the extended box provides an extended light source emitting light in addition to the light source.

18. The lighting apparatus of claim 1, wherein the driver box is inserted into a container via the central opening and the container hole.

19. The lighting apparatus of claim 18, wherein the driver box has a plugging structure to fix to the peripheral portion of the surface rim by plugging.

20. The lighting apparatus of claim 19, wherein when the driver box is plugged into the container, the first circuit is electrically connected to an external power source and the light source when the driver box is plugged to the plugging structure.

* * * * *